US006257738B1

(12) United States Patent
Hsu

(10) Patent No.: US 6,257,738 B1
(45) Date of Patent: Jul. 10, 2001

(54) DECORATIVE LAMP USED TO CONSTRUCT A LAMP WEB/NET

(76) Inventor: Yu-Yuan Hsu, 3 F, No. 11, Lane 200, Sung-Der Rd., Taipei (TW)

( * ) Notice: Subject to any disclaimer, the term of this patent is extended or adjusted under 35 U.S.C. 154(b) by 0 days.

(21) Appl. No.: 09/453,072

(22) Filed: Dec. 2, 1999

(51) Int. Cl.[7] ..... F21V 21/00
(52) U.S. Cl. ..... 362/249; 362/226; 362/396; 439/699.2; 439/619
(58) Field of Search ..... 362/249, 226, 362/396; 439/699.2, 619

(56) References Cited

U.S. PATENT DOCUMENTS 6,004,006 * 12/1999 Wang ..... 362/249
6,135,614 * 10/2000 Chen ..... 362/226

* cited by examiner

*Primary Examiner*—Alan Cariaso
*Assistant Examiner*—Ronald E. DelGizzi
(74) *Attorney, Agent, or Firm*—Bacon & Thomas, PLLC

(57) ABSTRACT

A decorative lamp is composed of a lamp holder and a bulb assembly received in the holder. The lamp holder has two first ears, each with a recess, integrally formed on the periphery thereof. The bulb assembly has two second ears to respectively mate with the first ears to define a passage. A plurality of decorative lamps is inter-connected to construct web or net configurations by cables in turn passed through and fixed in the mated first and second ears thereof.

7 Claims, 7 Drawing Sheets

DECORATIVE LAMP USED TO CONSTRUCT A LAMP WEB/NET

BACKGROUND OF THE INVENTION

1. Field of the Invention

The present invention is related to a decorative lamp, and more particularly to a lamp which can be constructed to a lamp web or net pattern.

2. Description of Related Art

A decorative lamp can be wound around or suspended on trees and buildings to provide a decorative effect. However, the conventional lamp only has a few varieties and cannot form more special configurations. The monotonous configurations are unattractive for customers.

Therefore, it is an objective of the invention to provide an improved decorative lamp to mitigate and/or obviate the aforementioned problems.

SUMMARY OF THE INVENTION

The main object of the present invention is to provide a decorative lamp which can be constructed to special web/net configurations.

Other objects, advantages and novel features of the invention will become more apparent from the following detailed description when taken in conjunction with the accompanying drawings.

| | |
|---|---|
| 10-lamp holder | 12-body |
| 14-wire | 16-rib |
| 18-conductive strip | 20-first ear |
| 22-notch | 30-bulb assembly |
| 32-flange | 34-second ear |
| 36-plug | 38-bulb |
| 40-foot | 50-cable |
| 52-protrusion | |

DETAILED DESCRIPTION OF THE PREFERRED EMBODIMENT

Figure 1:
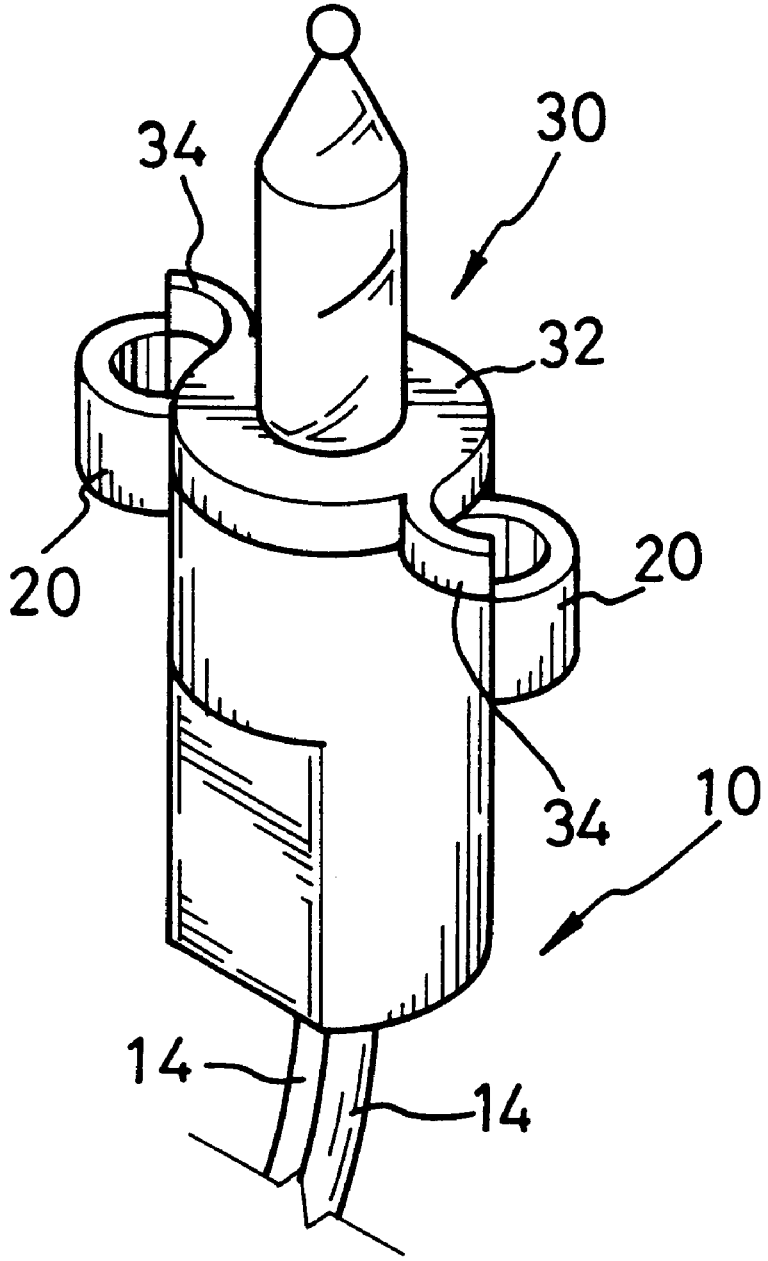
FIG. 1 is a perspective view of a decorative lamp in accordance with the invention.
Figure 2:
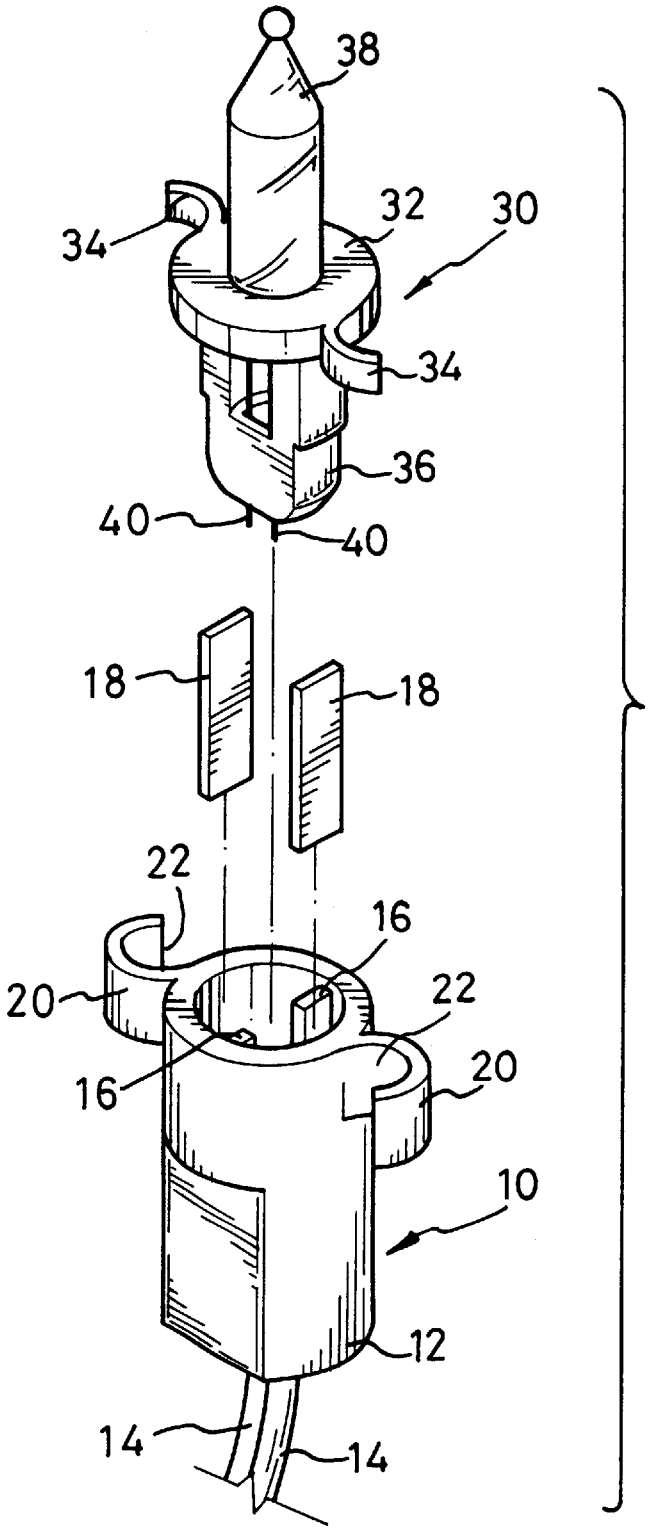
FIG. 2 is an exploded view of the decorative lamp in accordance with the invention.
Figure 3:
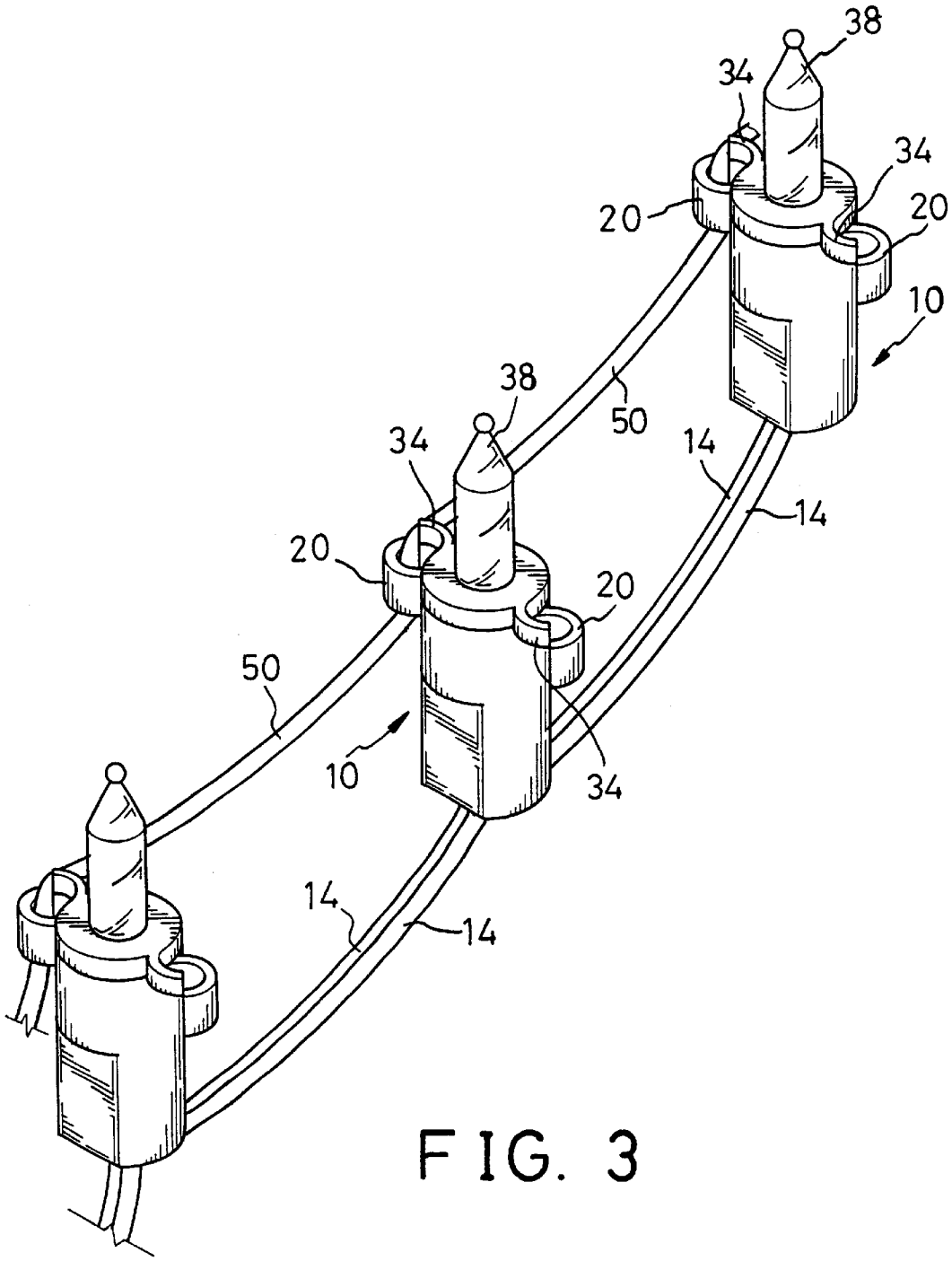
FIG. 3 is a perspective view showing that a plurality of lamps of the present invention is connected together.

Referring to FIGS. 1–3, a decorative lamp of the present invention comprises a lamp holder (10) and a bulb assembly (30) received in the lamp holder (10).

The lamp holder (10) has a hollow body (12) with a central passage (not numbered). Two ribs (16) are oppositely formed on an inner wall of the central passage. Two conductive strips (18), preferably made of copper, are respectively provided at opposite sides of the ribs (16). Two wires (14) are extended in the hollow body (12) via a bottom face thereof and are respectively electrically connected with the conductive strips (18). Two first ears (20) are oppositely formed on the outer periphery of the hollow body (12). The ears (20) are arcuate and each define a recess (22).

The bulb assembly (30) has a flange (32) of which a diameter is equal to an outer diameter of the lamp holder (10). The flange (32) prevents the bulb assembly (30) being inserted too deeply in the lamp holder (10). Two second ears (34) are oppositely formed on the outer periphery of the flange (32), with an arcuate configuration such that when the bulb assembly (30) is received in the hollow inner body (10), the first and second ears (20, 34) respectively align to form two passages. A plug (36) and a bulb (38) are respectively formed at bottom and top faces of the flange (32). The plug (36) is received in the central passage of the hollow body (12) and has two feet (40) provided on a bottom tip thereof to respectively electrically connect with the conductive strips (18).

A plurality of the decorative lamps is connected in series by a cable (50) which is in turn passed through and secured in the mated first and second ears (20,34) of the lamps, as shown in FIG. 3. The plurality of the decorative lamps is also electrically connected by the wires (14).

Figure 5:
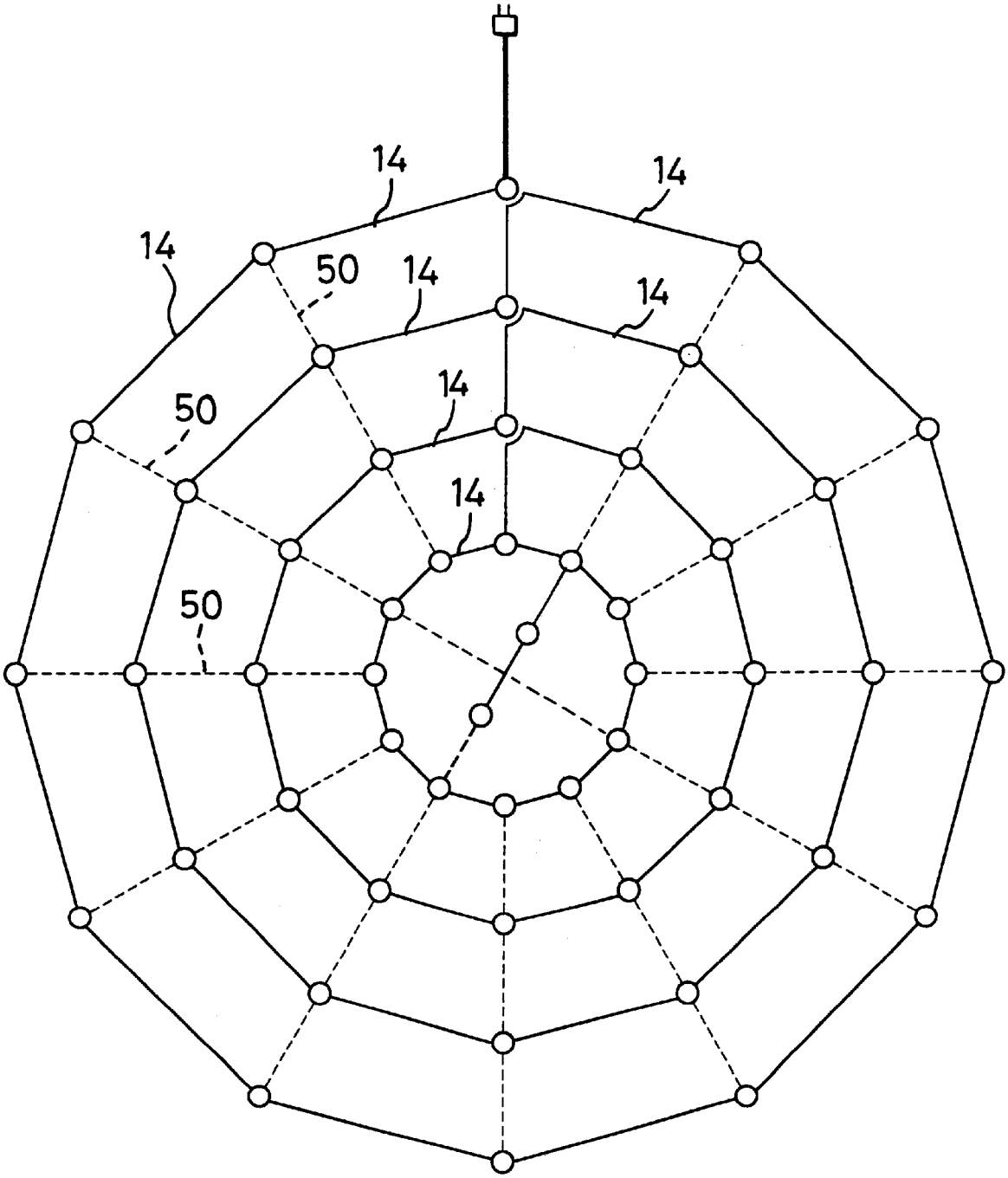
FIGS. 5–7 are schematic views of web or net configurations constructed with the lamps in accordance with the present invention.
Figure 6:
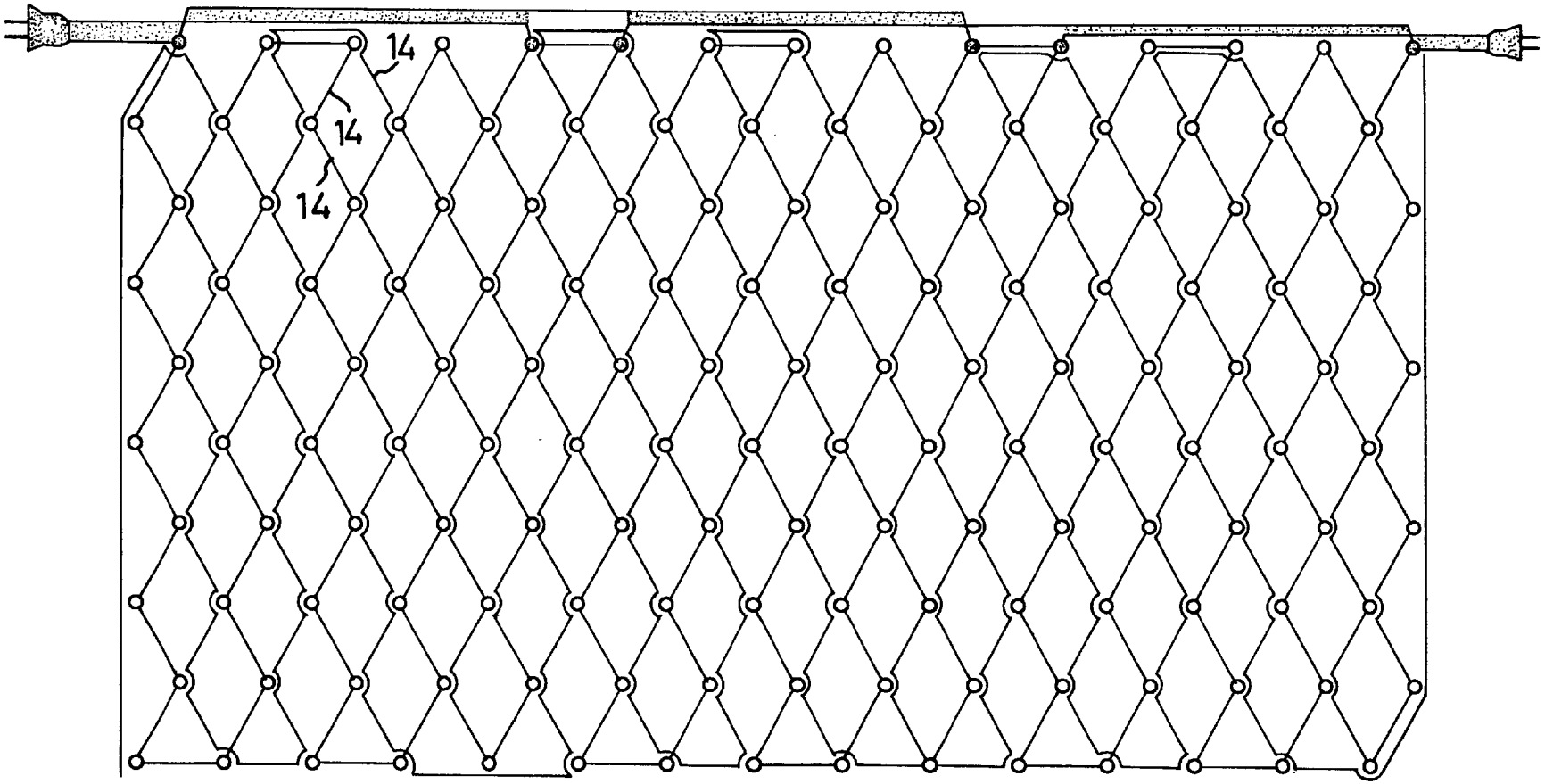
Figure 7:
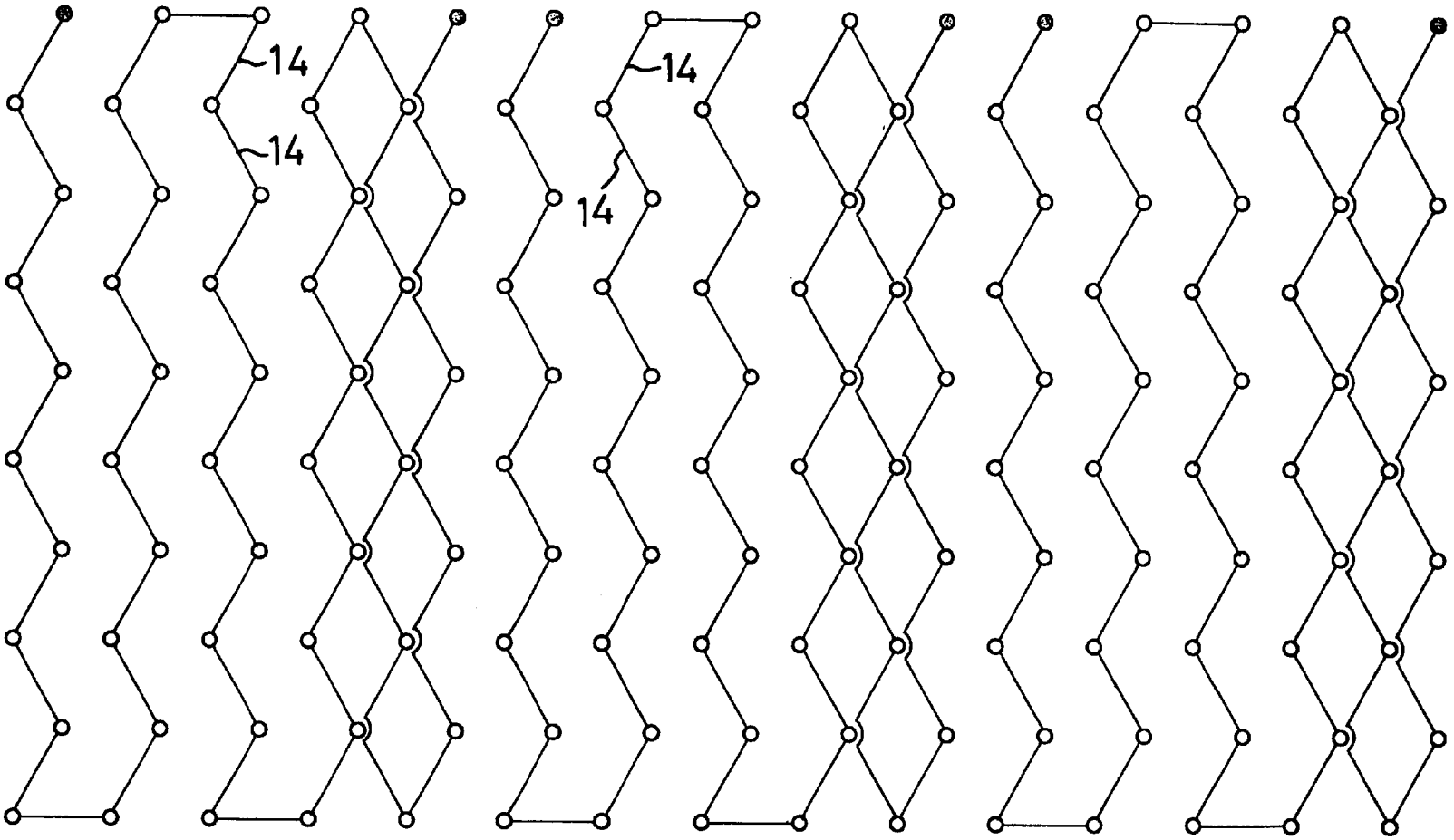

The decorative lamps can be constructed to special configurations. FIG. 5 shows a web configuration of the decorative lamps. In FIG. 5, the decorative lamps are arranged like a spiral. The wires (14) in turn electrically connect these decorative lamps along the spiral, and the cables (50) radially fasten the decorative lamps. Furthermore, FIGS. 6 and 7 show two types of net configuration of the present invention.

Figure 4:
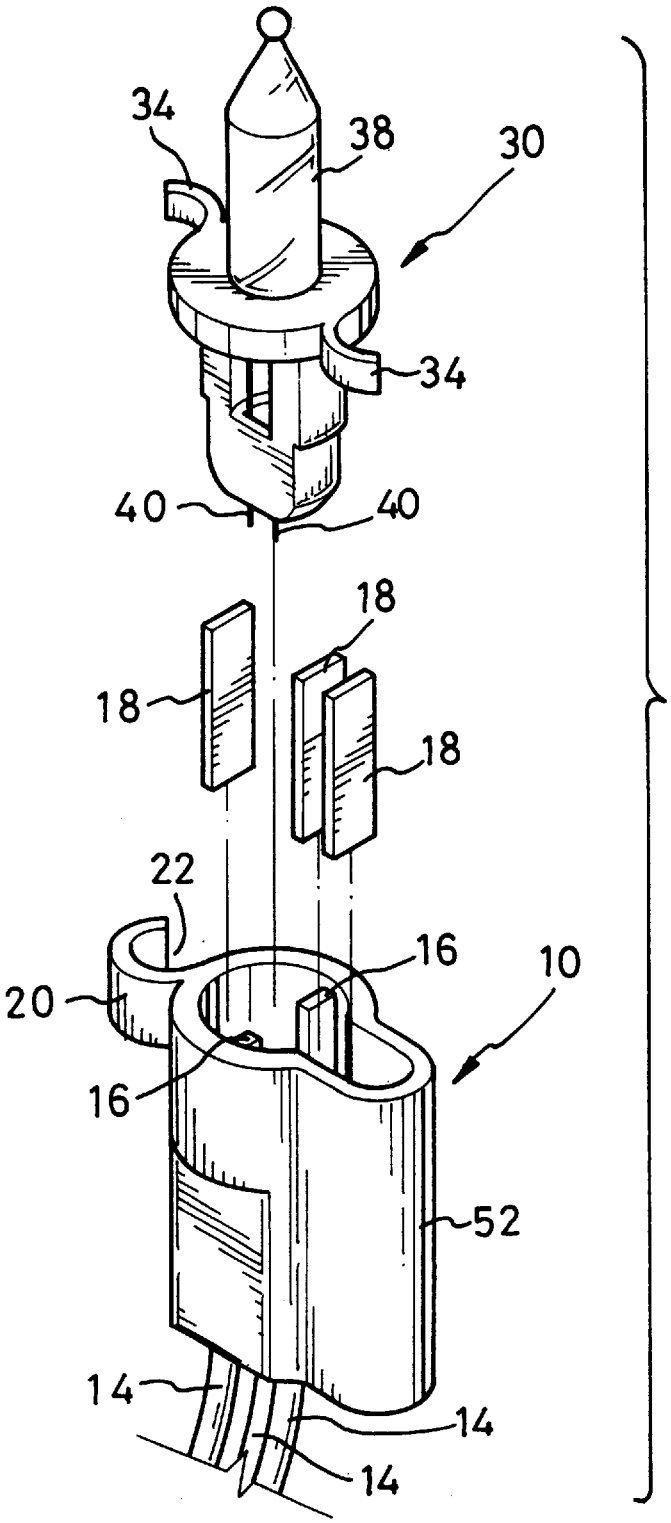
FIG. 4 is a perspective exploded view of another embodiment of the present invention.

A second embodiment of the present invention is shown in FIG. 4. In this embodiment, the lamp holder (10*a*) further has a protrusion (52') integrally formed with the hollow body (12') and thus only one second ear (20') is formed on the outer periphery of the hollow body (12'). The protrusion (52') has a channel (not numbered) defined therein and in communication with the central passage of the hollow body (12'). Three conductive strips (18') are provided in the lamp holder (10'), wherein two of them are disposed in the central passage and respectively at the opposite sides of the ribs (16'), and the third is disposed in the channel. Three wires (14') are extended in the hollow body (12') via the bottom face thereof and are respectively electrically connected with the conductive strips (18'). The bulb assembly (30) is same as that of the first embodiment described above.

From the above description, the decorative lamp of the present invention can be formed to a variety of web or net configurations to provide a more attractive decorative effect.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A decorative lamp, comprising:

a holder (10) having a hollow body (12); at least one first ear (20) with a recess (22), integrally formed on a periphery of the body (12), and two conductive strips (18) provided in the hollow body (12) and respectively electrically connected with two wires (14) extended in the hollow body (12);

a bulb assembly (30) having a flange (32), a plug (36) which is received in the hollow body (12) and a bulb

(38) respectively formed on opposite faces of the flange (32), at least one second ear (34) integrally formed on a periphery of the flange (32) to mate with the at least one first ear (20) to define a passage; and two feet (40) provided at a bottom face of the plug (36) and respectively electrically connected with the conductive strips (18);

whereby a plurality of the decorative lamps can be connected together to construct a variety of web or net configurations by cable(s) in turn passed through and fixed in the mated first and second ears (20, 34) thereof.

2. The decorative lamp as claimed in claim 1, wherein the hollow body (12) further comprises two ribs (16) respectively formed on the opposite inner walls thereof between the two conductive strips (18).

3. The decorative lamp as claimed in claim 1, wherein the diameter of the flange (32) is equal to the outer diameter of the lamp holder (10).

4. A decorative lamp, comprising:

a holder (10*a*) having a hollow body (12*a*) with a central passage; a protrusion (52) defining a channel in communication with the central passage integrally formed with the body (12*a*), a first ear (20) with a notch (22) integrally formed on the periphery of the body (12*a*); three conductive strips (18) provided in the hollow body (12), and three wires (14) extended in the hollow body (12*a*) by the bottom and respectively electrically connected with the conductive strips (18);

a bulb assembly (30) having a flange (32), a plug (36) which is received in the hollow body (12) and a bulb (38) respectively provided on the opposite sides of the flange (32), at least one second ear (34) integrally formed on an outer periphery of the flange (32) to mate with the first ear (20) to define a passage; and three feet (40) provided at a bottom face of the plug (36) and respectively electrically connected with the conductive strips (18);

whereby a plurality of the decorative lamps can be connected together to construct a variety of web or net configurations by cable(s) in turn passed through and fixed in the mated first and second ears (20, 34) thereof.

5. The decorative lamp as claimed in claim 4, wherein two of the conductive strips (18) are provided in the central passage, and the third conductive strip (18) is provided in the channel.

6. The decorative lamp as claimed in claim 4, wherein the hollow body (12) further comprises two ribs (16) respectively formed on the opposite inner walls thereof between the two conductive strips (18) provided in the central passage.

7. The decorative lamp as claimed in claim 4, wherein the diameter of the flange (32) is equal to the outer diameter of the lamp holder (10).

* * * * *